US008522593B2

(12) United States Patent
Flehmig et al.

(10) Patent No.: US 8,522,593 B2
(45) Date of Patent: Sep. 3, 2013

(54) METHOD AND DEVICE FOR PRODUCING HIGHLY DIMENSIONALLY ACCURATE FLANGED HALF SHELLS

(75) Inventors: Thomas Flehmig, Ratingen (DE); Konstantinos Savvas, Oberhausen (DE); Lothar Hömig, Voerde (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 20 days.

(21) Appl. No.: 12/625,211

(22) Filed: Nov. 24, 2009

(65) Prior Publication Data

US 2010/0133724 A1 Jun. 3, 2010

(30) Foreign Application Priority Data

Nov. 28, 2008 (DE) ..... 10 2008 037 612

(51) Int. Cl.
*B21D 22/00* (2006.01)

(52) U.S. Cl.
USPC ..... 72/348

(58) Field of Classification Search
USPC ..... 72/332, 334, 347, 348, 350, 379.2, 72/349
See application file for complete search history.

(56) References Cited

U.S. PATENT DOCUMENTS

| | | | | |
|---|---|---|---|---|
| 1,098,716 | A * | 6/1914 | Garrison | 470/8 |
| 1,892,754 | A * | 1/1933 | Tarbox | 72/378 |
| 2,966,873 | A * | 1/1961 | Hoffman et al. | 72/57 |
| 3,814,040 | A * | 6/1974 | Habash | 72/348 |
| 4,386,514 | A * | 6/1983 | Herten | 72/347 |
| 4,407,428 | A * | 10/1983 | Stone | 220/801 |
| 4,434,640 | A * | 3/1984 | Walter et al. | 72/348 |
| 5,369,972 | A * | 12/1994 | Kajiwara et al. | 72/348 |
| 5,483,813 | A * | 1/1996 | Clark et al. | 72/334 |
| 5,910,052 | A * | 6/1999 | Ellis et al. | 470/6 |
| 5,953,951 | A * | 9/1999 | Fujimoto et al. | 72/379.6 |
| 5,987,956 | A * | 11/1999 | Strube et al. | 72/348 |
| 6,038,910 | A * | 3/2000 | McClung | 72/348 |
| 6,205,831 | B1 * | 3/2001 | Adey et al. | 72/47 |
| 7,171,838 | B2 * | 2/2007 | Shiokawa | 72/356 |
| 7,536,892 | B2 * | 5/2009 | Amino et al. | 72/305 |
| 7,596,980 | B2 * | 10/2009 | Kimura et al. | 72/348 |
| 7,624,611 | B2 * | 12/2009 | Saitou | 72/349 |
| 7,761,971 | B2 * | 7/2010 | Cheng | 29/505 |

(Continued)

FOREIGN PATENT DOCUMENTS

| | | |
|---|---|---|
| CN | 1042099 A | 5/1990 |
| CN | 2645811 Y | 10/2004 |

(Continued)

*Primary Examiner* — Edward Tolan
(74) *Attorney, Agent, or Firm* — Reinhart Boerner Van Deuren P.C.

(57) ABSTRACT

A method for producing highly dimensionally accurate, deep-drawn half shells with a base region, a body region and a flange region, includes firstly forming a pre-formed half shell from a blank and then shaping the pre-formed half shell into a finally formed half shell, wherein the pre-formed half shell has excess blank material due to its geometric shape and wherein, owing to the excess material during the shaping of the pre-formed half shell into its final shape the half shell is compressed into the finally formed half shell by at least one further pressing process. The method requires that the pre-formed half shell has excess blank material in a transition region between the body region and flange region.

9 Claims, 4 Drawing Sheets

(56) References Cited

U.S. PATENT DOCUMENTS

| | | | | |
|---|---|---|---|---|
| 2004/0244459 | A1 | 12/2004 | Shiokawa | |
| 2006/0125140 | A1 | 6/2006 | Saitou | |
| 2006/0272378 | A1 | 12/2006 | Amino et al. | |
| 2007/0125149 | A1 | 6/2007 | Yoshitome et al. | 72/356 |
| 2008/0148799 | A1 | 6/2008 | Kimura et al. | |
| 2009/0255317 | A1* | 10/2009 | Flehmig et al. | 72/348 |
| 2009/0305075 | A1* | 12/2009 | Flehmig et al. | 428/603 |

FOREIGN PATENT DOCUMENTS

| | | | |
|---|---|---|---|
| DE | 102006020000 | B3 | 11/2007 |
| EP | 1 792 671 | A1 | 6/2007 |
| WO | 2007/125051 | | 11/2007 |

* cited by examiner

METHOD AND DEVICE FOR PRODUCING HIGHLY DIMENSIONALLY ACCURATE FLANGED HALF SHELLS

CROSS-REFERENCE TO RELATED APPLICATION

This application claims the benefit of and priority to German patent application no. DE 10 2008 037 612.4-14, filed on Nov. 28, 2008. The disclosure of the above application is incorporated herein by reference in its entirety.

FIELD OF THE INVENTION

The invention relates to a method for producing highly dimensionally accurate, deep-drawn half shells with a base region, a body region and a flange region, wherein a pre-formed half shell is firstly formed from a blank and is then shaped into the finally formed half shell, wherein the pre-formed half shell has excess blank material due to of its geometric shape and wherein owing to the excess material during the shaping of the pre-formed half shell into its final shape the half shell is compressed into the finally formed half shell by at least one further pressing process. The invention also relates to a tool set for producing a highly dimensionally accurate deep-drawn half shell with flange regions with a first tool for producing a pre-formed half shell, the first tool comprising a first bottom die, and with a second tool for producing the finally formed half shell, the second tool comprising a second bottom die, the shape of which substantially corresponds to the negative of the outer shape of the finally formed half shell.

BACKGROUND

Closed hollow profiles, which have cross-sections and material thicknesses specially adapted to the application are increasingly being used in motor vehicles. Closed hollow profiles were previously generally produced in that firstly a tube is formed, the tube is subjected to corresponding bending and pre-forming processes and then a hydro-forming of the pre-bent or pre-formed tube into the final shape of the closed hollow profile takes place. On the one hand, not all components can be produced in this manner as in hydro-forming local elongations of the material are exceeded and thus cracks may form. In addition, there may be a non-manageable formation of folds during the hydro-forming. Moreover, the method steps previously used to produce a closed hollow profile adapted to the application are very complex and therefore expensive. A closed hollow profile may, in principle, also be produced from two deep-drawn half shells. During the deep-drawing of a blank, stresses are, however, introduced into the blank and lead to a spring-back of the half shell. The spring-back of the half shells makes the precise positioning of the half shells in a bottom die for welding the half shells into a closed hollow profile more difficult.

Assembling half shells which spring back strongly in a vehicle structure is very complex, however, because of the strong distortion. These parts alternatively have to be straightened and this entails very high costs.

A method for press-forming half shells, which are then welded to form a closed hollow profile, is known from the published European patent application EP 1 792 671 A1. The object of the European patent application mentioned is to provide half shells with thickened edge regions between the base region and the body. For this reason, a pre-formed half shell is firstly produced from a blank which provides excess material which is pressed during shaping into the final form from the base region into the edge regions between the body and the base region of the half shell. In comparison, the present invention deals with reducing the spring-back of deep-drawn half shells.

SUMMARY OF THE INVENTION

Proceeding from this, the present invention is based on the technical problem of providing a method and a tool set for producing highly dimensionally accurate flanged half shells, with which, with a low outlay for apparatus, highly dimensionally accurate flanged half shells can be economically produced.

This technical problem is achieved according to the invention in that the pre-formed half shell has the excess blank material in the transition region between the body region and flange region. This transition region is taken to mean the body region adjoining the flange region and the flange region adjoining the body region. When producing half shells by simple deep drawing, strong geometrical deviations from the intended shape frequently occur in the transition region. This transition region is therefore particularly critical when producing highly dimensionally accurate flanged half shells. For example, deep drawing in the transition region may lead to the formation of cracks or premature material fatigue. Such problems are reliably avoided by the excess material in the transition region.

According to a preferred embodiment, the pre-formed half shell has the excess blank material at least in the base region and in the body region or in the base region and in the flange region, so the half shell is highly dimensionally accurate after the second pressing process in its entire cross-section and a spring-back is prevented. Furthermore, the finally formed half shell has a shape corresponding very precisely to the geometry of the second bottom die. The invention is based on the recognition that to produce highly dimensionally accurate flanged half shells, it is necessary to compress the pre-formed half shell over its entire cross-section. Therefore, the excess material required for compression also has to be available over the entire cross-section.

The excess blank material is provided in a further preferred embodiment of the invention in that the central flange radius in the transition region between the body region and flange region in the pre-formed half shell is greater or smaller than in the final shape. The central flange radius is taken to mean the radius of the circle, with the periphery of which the course of the half shell best coincides in the transition region between the body region and flange region. It is thus unnecessary for the transition region of the half shell between the body region and flange region to actually be arc of a circle-shaped. Thus, the transition region may, for example, have the shape of an elliptical arch, a parabola or another shape. The provision of excess blank material is achieved in a very simple manner by this embodiment.

Furthermore, a very simple first bottom die can be used to produce the pre-formed half shell. The formation of a larger flange radius is advantageous, in particular, in the case of large drawing depths and leads to a smaller wall thinning of the pre-formed half shell in the body region. Formation of a smaller flange radius is advantageous for the lateral wall ironing of the flange region and thus reduces the spring-back of the pre-formed half shell. To reduce the spring-back of the pre-formed half shell, additional measures may also be provided in both variants, such as, for example, body wall ironing, via flange moderation by means of moderating crimps/beads and/or by adjusting the forces of the holding-down device.

A further improvement of the dimensional accuracy of the half shell, in particular in the flange region, is achieved in a further preferred embodiment in that the material flow of the half shell at the flange edges of the half shell is blocked, at least intermittently, during the pressing process. This means that no blank material is pressed out of the pressing region and thus the entire excess blank material is completely compressed into the finally formed half shell, so the half shell is reinforced in particular at the critical points for the dimensional accuracy.

The blocking of the material flow of the half shell to the outside can be achieved in a particularly preferred manner by a blocking wall provided on the calibration top die used for the pressing process. This, on the one hand, has the advantage that no additional moveable component has to be provided to block the material flow to the outside. On the other hand, it is thus achieved that the blocking wall blocking the material flow travels into the position provided for blocking precisely during the pressing process bringing about the material flow.

In a further preferred embodiment, the pre-formed half shell is trimmed in the flange region before or during the pressing process in the same bottom die. This means that the half shell already has its completely finished final shape after the pressing process. This saves a working step and therefore time and costs.

The precision and cleanness of the trimming of the half shell is achieved in a further preferred embodiment in that the pre-formed half shell is fixed by a holding-down device in the flange region before trimming. This prevents a change of the position of the half shell during trimming and therefore the formation of an unclean cutting edge. An advantageous control of the material flow in the half shell is achieved by maintaining the fixing during the pressing process with simultaneous blocking of the material flow to the outside. Thus the fixing during the pressing process leads to a material flow of the excess material from the flange region into the transition region between the body region and flange region. Furthermore, the pre-formed half shell is reliably held in the second bottom die by the fixing so the calibration top die of the second bottom die can travel more precisely into the bottom die.

A particularly precise and clean cutting edge in the flange region of the half shell is achieved in a further preferred embodiment by the use of a laser for trimming the flange region.

The blocking of the material flow of the half shell to the outside is blocked in a further preferred embodiment by the cutting top dies carrying out the trimming. If the half shell in the second bottom die is trimmed, this is particularly advantageous as no additional components are necessary to block the material flow to the outside. This allows the method to be carried out more easily, faster and more economically.

The method according to the invention is particularly suitable for producing half shells made of steel or a steel alloy. Therefore, the blank to produce the pre-formed half shell in a preferred embodiment consists of steel or a steel alloy.

The technical problem is furthermore achieved by a tool set in that the bottom die of the first tool in the transition region between the body region and flange region differs from the shape of the bottom die of the second tool in such a way that the pre-formed half shell in the transition region has more material than is required for the finally formed half shell. During deep-drawing, in particular in the transition region between the body region and flange region of the half shell, strong geometric deviations frequently occur. The tool set according to the invention means that the half shell pre-formed in the first bottom die differs, in particular in this region, from the shape of the second bottom die and therefore excess material is available in the second bottom die during the pressing process and leads to a high dimensional accuracy in this region.

According to a first embodiment, the bottom die of the first tool deviates at least in the base region and in the body region or in the base region and in the flange region from the shape of the bottom die of the second tool in such a way that the pre-formed half shell in the base region and in the body region or in the base region and in the flange region has more material than is required for the finally formed half shell. In the pressing process, a material flow of the excess blank material is produced in the second bottom die in order to orientate the stresses in the blank material which then counteract an uncontrolled spring-back. Moreover, the half shell is to be reinforced by the material flow in the regions otherwise thinned by the deep-drawing. This leads to a high dimensional accuracy of the finally formed half shell. The deviations of the shape of the first bottom die from the shape of the second bottom die can thus be formed as undulating, convex or concave, inward or outward bulges.

The deviations of the shape of the first bottom die from the shape of the second bottom die are achieved in a further preferred embodiment in that the bottom die of the first tool in the transition region between the body region and flange region has a larger or smaller flange radius than the bottom die of the second tool. The pre-formed half shell inserted into the second bottom die, in the transition region between the body region and the flange region, thus does not rest on the second bottom die, but has a deviating course with an increased material quantity. The latter is produced in the case of a larger flange radius owing to the extended flange region, and with a smaller flange radius, owing to the relatively large curvature length in the transition region between the body region and flange region. During the pressing process, the half shell is pressed onto the second bottom die and the excess blank material reinforces the half shell above all in the transition region.

So that the excess blank material remains completely in the second bottom die during the pressing process and thus leads to a reinforcement and therefore higher dimensional accuracy of the half shell, the second tool comprises means in a preferred embodiment which block the material flow to the outside, at least intermittently during the pressing process of a half shell to be shaped into the final shape on the flange edges of a component inserted into the second tool.

This can be achieved in a further preferred embodiment in that the second tool comprises a calibration top die and a blocking wall for blocking the material flow or a cutting top die for the flange trimming with an integrated blocking wall. The calibration top die and the blocking wall may, in this case, form a unit or be moved separately. When providing a cutting top die, the half shell is directly trimmed in the second bottom die. The work sequence can thus be reduced by one working step. The cutting top die is also suitable, in particular, for the integration of the blocking wall, as the latter thus does not need to be moved individually.

BRIEF DESCRIPTION OF THE DRAWINGS

Further features and advantages of the present invention are described in more detail in the description of some embodiments, reference being made to the accompanying drawings, in which.

DESCRIPTION

Figure 1:
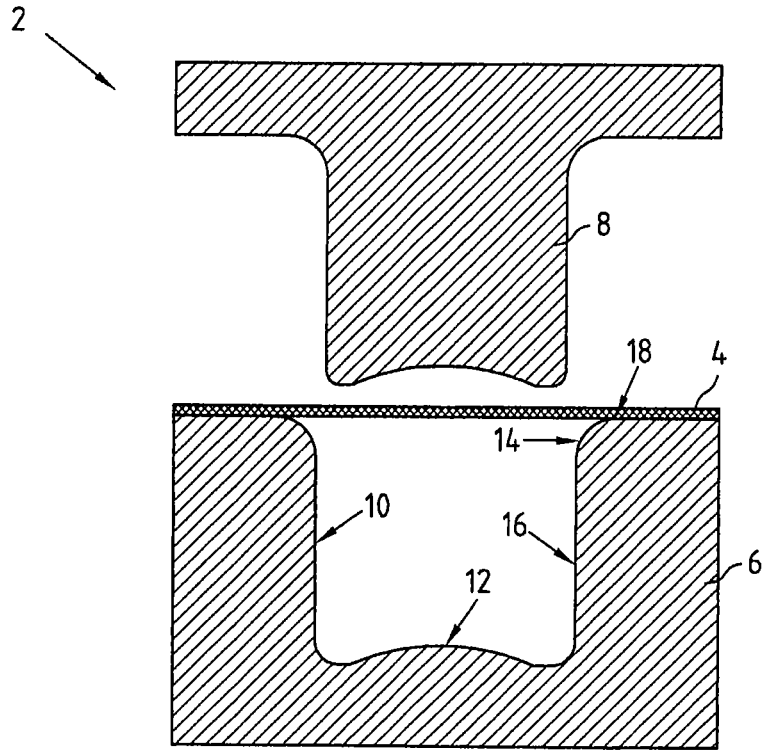
FIG. 1 shows an embodiment of the first tool of a tool set according to the invention for producing a pre-formed half shell from a blank.

The first tool 2 of an embodiment of a tool set according to the invention for producing a pre-formed half shell from a blank 4, shown in FIG. 1, comprises a first bottom die 6 and a deep-drawing top die 8. The general shape of the inside 10 of the bottom die 6 is similar to the shape of the outside of the finally formed half shell to be produced with the tool set. In the transition region 14 between the body region 16 and the flange region 18 of the bottom die 6 and in the base region 12, the inside 10 of the bottom die 6 deviates with respect to its shape, however, from the shape of the outside of the finally formed half shell to be produced with the tool set. Thus, the inside 10 of the bottom die 6 in the base region 12 has an undulating shape. Alternatively, a simple concave or convex shape or another shape deviating from the intended shape of the base region or the finally formed half shell is also conceivable. Furthermore, the flange radius in the transition region 14 and the height of the shape, in other words the distance between the base region 12 and the flange region 18, is increased. Alternatively, a bottom die is conceivable, in which the flange radius is reduced, but the height is not increased. The deep-drawing top die 8 has a shape adapted to the shape of the bottom die 6, so the blank 4 is deep drawn by lowering the deep-drawing top die 8 into the bottom die 6 to form a pre-formed half shell.

Figure 2:
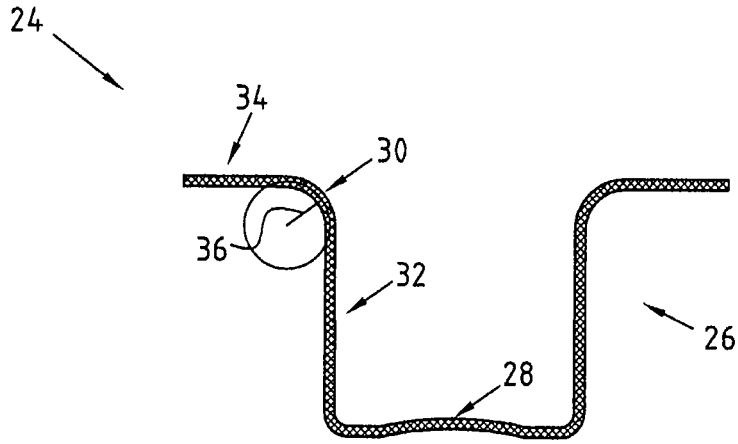
FIG. 2 shows a half shell pre-formed in the first bottom die.

FIG. 2 shows a pre-formed half shell 24 after deep drawing with the first tool shown in FIG. 1. The outside 26 of the pre-formed half shell 24 substantially corresponds to the inside 10 of the bottom die 6, but deviates through spring-back from the precise shape of the inside 10 of the bottom die 6. In the transition region 30 between the body region 32 and the flange region 34, the pre-shaped half shell 24 has an enlarged flange radius 36. The base region 28 of the pre-formed half shell 24 is undulating in accordance with the shape of the base region 12 of the bottom die 6.

Figure 3:
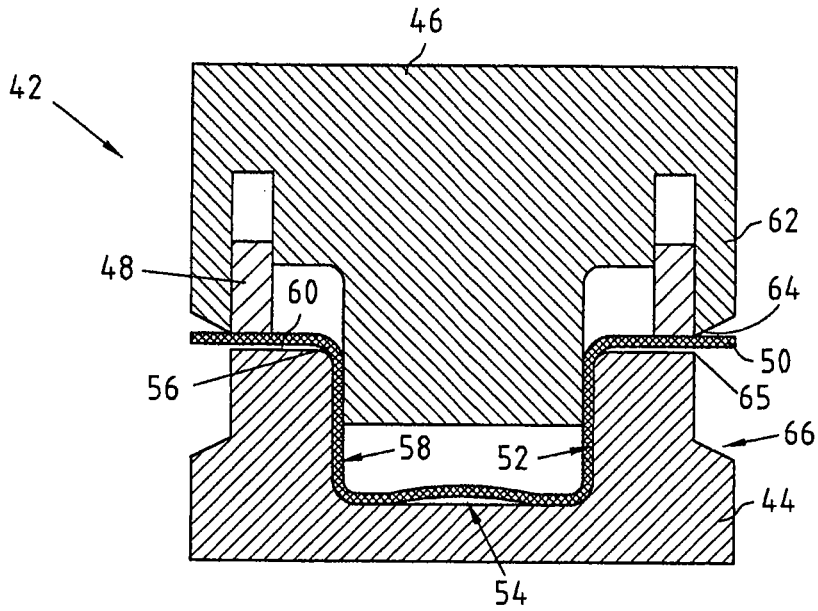
FIG. 3 shows a first embodiment of the second tool of a tool set according to the invention with a pre-formed half shell inserted therein, produced with a first tool of a tool set according to the invention.

The second tool 42 shown in FIG. 3 of a tool set according to the invention comprises a second bottom die 44, a calibration top die 46 and a holding-down device 48. A pre-formed half shell 50, which was produced by the tool shown in FIG. 1, is inserted into the bottom die 44. The shape of the inside 52 of the bottom die 44 corresponds to the shape of the outside of the finally shaped half shell to be produced. The half shell 50 therefore does not rest completely on the inside 52 of the bottom die 44, but stands away from the inside 52 of the bottom die 44, in particular, in the base region 54 owing to its undulating shape and, in the transition region 56 between the body region 58 and flange region 60 and in the flange region 60 owing to the greater flange radius in the transition region 56. The height of the pre-formed half shell 50 is thus greater than the height of the finally formed half shell to be produced. The pre-formed half shell 50, owing to these regions standing away, has excess blank material which is distributed during the lowering of the calibration top die 46 by a material flow on the half shell and leads to a high dimensional accuracy of the finally shaped half shell. The calibration top die 46 has a shape corresponding to the inside of the half shell to be produced. A cutting top die 62 with a cutting edge 64 is integrated into the calibration top die 46. When lowering the calibration top die 46, the pre-formed half shell 50 is thus trimmed in the flange region 60 by the cutting edge 64 on the edge 65 of the bottom die 44 to the intended size. The bottom die 44, in the region of the cutting top die 62, has a recess 66, so the cutting die 62 can be lowered and the cut-off piece of the pre-shaped half shell can fall down. The pre-formed half shell 50 in the flange region 60 is fixed by the holding-down device 48 and this leads to a very clean trim of the pre-formed half shell 50 by the cutting edge 64. In a preferred manner, the calibration top die 46 with the cutting top die 62 is firstly positioned at an adequate height above the pre-formed half shell 50 in the bottom die 44. It thus has no contact with the base region and the flange region of the pre-formed half shell 50. The holding-down device 48 is then moved down, for example, by means of sleeves let into the calibration top die and fixes the pre-formed half shell 50 in the flange region 60. When using a pre-formed half shell 50 with the greater flange radius this leads to an arcuate deformation of the pre-formed half shell 50 in the flange region. With a pre-formed half shell 50 with a smaller flange radius no such deformation occurs and there is therefore a cleaner trim. This is advantageous, in particular in the case of greater sheet metal thicknesses. Finally, the calibration top die 46 and the cutting top die 62 move down completely. In the process, the cutting top die 62 firstly cuts off the projecting flange region of the pre-shaped half shell 50 and blocks the material flow of the blank material to the outside during the further downward movement. The pre-formed half shell 50 is compressed over its entire cross-sectional area by the calibration top die 46 into the finally formed half shell by the excess blank material in the transition region 30 as well as in the base region 54 and in the flange region 60 or in the base region 54 and in the body region 58 of the half shell 50. Said half shell can only change with respect to its sheet metal thickness during the compression process and is therefore formed with good dimensional accuracy.

Figure 4:
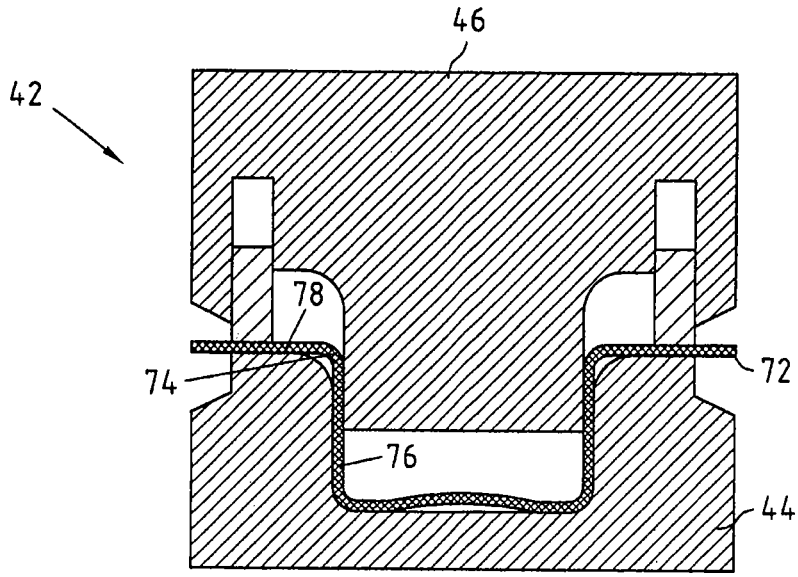
FIG. 4 shows a first embodiment of the second tool from FIG. 3 with a pre-formed half shell inserted therein, produced with a further first tool of a tool set according to the invention.

FIG. 4 shows the second tool 42 from FIG. 3. A pre-formed half shell 72 produced by means of a second embodiment of the first tool of a tool set according to the invention is inserted into the bottom die 44. The pre-formed half shell 72 differs from the pre-formed half shell 50 shown in FIG. 3 in that the transition region 74 between the flange region 76 and the body region 78 has a smaller flange radius than the bottom die 44. Furthermore, the height of the pre-formed half shell 72 coincides with the height of the finally formed half shell to be produced and therefore with the depth of the bottom die 44. Owing to the smaller flange radius, the pre-formed half shell 72 in the transition region 74 does not rest on the inside 52 of the bottom die 44. Thus, excess blank material is available at this point owing to the extended curvature region during the lowering of the calibration top die 46.

Figure 5:
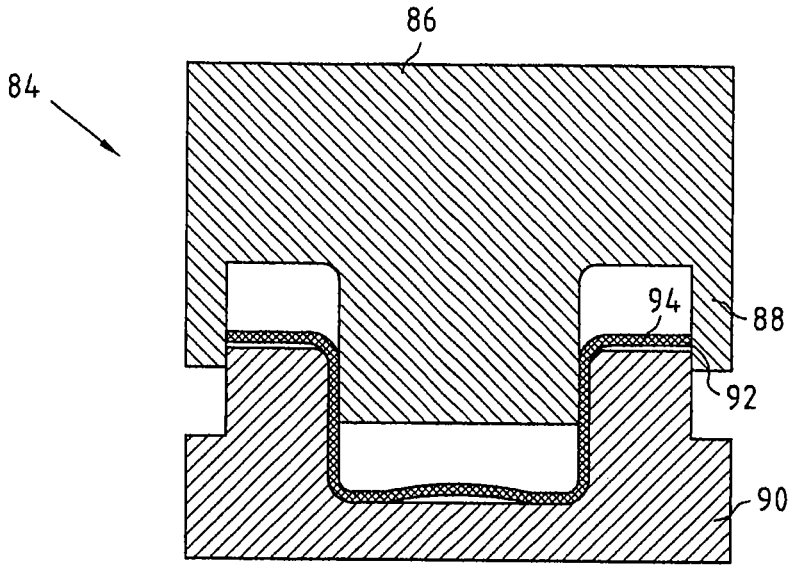
FIG. 5 shows a second embodiment of the second tool of a tool set according to the invention with a pre-formed half shell inserted therein, produced and trimmed with a first tool of a tool set according to the invention.

The second tool of a tool set according to the invention shown in FIG. 5, in contrast to the second tool 42 shown in FIG. 3, has no holding-down device and no cutting edge.

Instead of a cutting top die, the calibration top die 86 has a blocking wall 88. A pre-formed half shell 92 is inserted into the bottom die 90. In contrast to the pre-formed half shell 50 shown in FIG. 3, the pre-formed half shell 92 in the flange region 94 already has the size of the finally formed half shell to be produced. This is achieved, for example, in that a pre-formed half shell produced by a first tool is trimmed in a separate working step before insertion into the bottom die 90. In this manner, the structure of the second tool and the method sequence are simplified, as no holding of the calibration or cutting top die in an intermediate position is necessary to lower the holding-down device.

Figure 6:
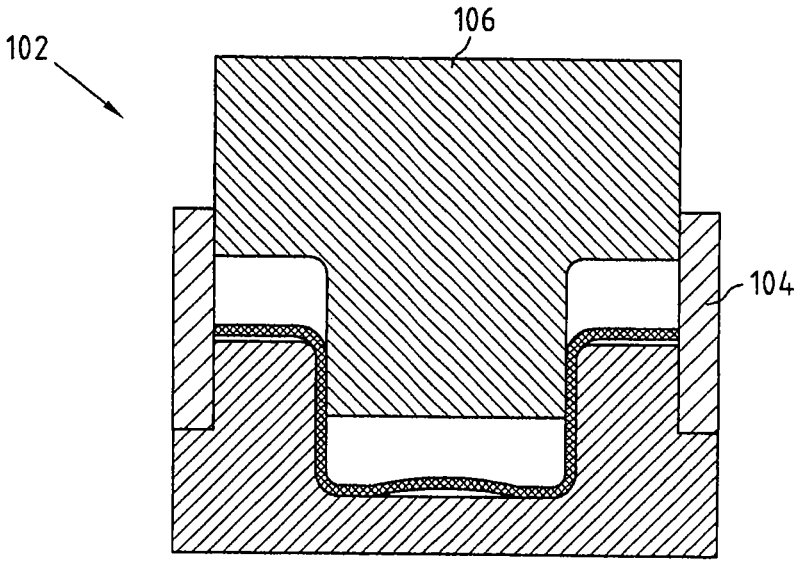
FIG. 6 shows a third embodiment of the second tool of a tool set according to the invention with a pre-formed half shell inserted therein, produced and trimmed with a first tool of a tool set according to the invention

The second tool 102 of a tool set according to the invention shown in FIG. 6 differs from that shown in FIG. 5 in that the blocking wall 104 is configured as a separate part from the calibration top die 106 and can be moved independently of the calibration top die 106.

Figure 7:
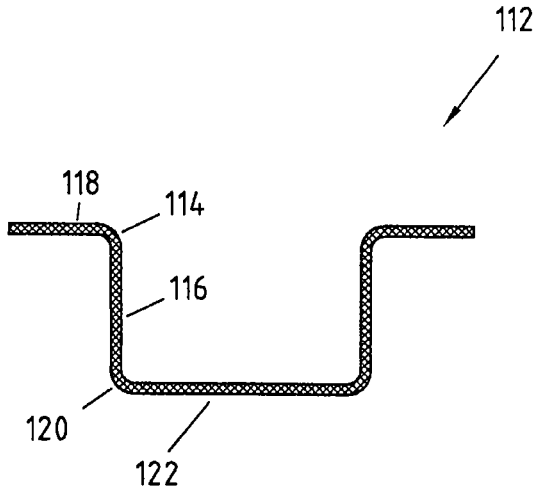
FIG. 7 shows a finally formed half shell produced with a tool set according to the invention.

A finally formed half shell 112 produced by a tool set according to the invention is shown in FIG. 7. In particular in the transition region 114 between the body region 116 and flange region 118 as well as in the transition region 120 between the base region 122 and flange region 118, it has high dimensional accuracy and great stability.

What is claimed is:

1. A method for producing highly dimensionally accurate, deep-drawn half shells, the method comprising the steps of:

forming a pre-formed half shell from a blank such that is has a base region, a body region depending upwardly from the base region having opposed sidewalls, a flange region depending outwardly from the body region, and a transition region between the body region and the flange region;

wherein the step of forming includes forming the pre-formed half shell such that it possesses a substantially constant wall thickness in its entirety; and wherein the step of forming includes forming the pre-formed half shell such that it possesses excess blank material due to its geometrical shape, particularly in a single bend in the transition region, the single bend having a first central flange bend radius in the transition region thereof between the flange region and the body region;

pressing the pre-formed half shell into a finally finished product, wherein the excess blank material of the single bend in the transition region of the pre-formed half shell is provided such that the single bend has a second central flange bend radius in a transition region of the finally finished product that is different than the first central flange bend radius after the step of forming.

2. The method according to claim 1, wherein the step of forming includes forming the pre-formed half shell such that it possesses excess blank material at least in the base region and in the body region or in the base region and in the flange region.

3. The method according to claim 1, wherein at least intermittently during the step of pressing the pre-formed half shell into a finally finished product, material flow of the half shell at the flange edges of the half shell is blocked.

4. The method according to claim 3, wherein material flow of the half shell is blocked to the outside by a blocking wall provided on a top die used for the step of pressing.

5. The method according to claim 1, wherein the pre-formed half shell is trimmed in the flange region at one of before or during the step of pressing in a same bottom die.

6. The method according to claim 5, wherein the pre-formed half shell is fixed by a holding-down device in the flange region before trimming.

7. The method according to claim 5, wherein the pre-formed half shell is trimmed in the flange region by means of a laser.

8. The method according to claim 5, wherein material flow of the half shell to the outside is blocked by cutting top dies carrying out the trimming.

9. The method according to claim 1, wherein the blank consists of steel or a steel alloy.

* * * * *